US006235180B1

(12) United States Patent
Kobayashi et al.

(10) Patent No.: US 6,235,180 B1
(45) Date of Patent: May 22, 2001

(54) METHOD FOR FORMING PHOSPHATE FILM ON THE STEEL WIRES AND APPARATUS USED THEREFORE

(75) Inventors: Naoyuki Kobayashi; Atsushi Moriyama, both of Tokyo; Shigemasa Takagi; Tomoaki Katsumata, both of Gifu, all of (JP)

(73) Assignees: Nihon Parkerizing Co., Ltd., Tokyo; Fujisyouji Kabushikigaisha, Gifu, both of (JP)

( * ) Notice: Subject to any disclaimer, the term of this patent is extended or adjusted under 35 U.S.C. 154(b) by 0 days.

(21) Appl. No.: 09/343,471

(22) Filed: Jun. 30, 1999

(30) Foreign Application Priority Data

Jul. 1, 1998 (JP) ..... 10-185830

(51) Int. Cl.[7] ..... C25D 7/06

(52) U.S. Cl. ..... 205/141; 205/149; 205/170; 205/188; 205/219; 205/318; 205/320; 204/206; 204/208; 204/209

(58) Field of Search ..... 205/141, 149, 205/170, 188, 219, 318, 320; 204/206, 208, 209

(56) References Cited

U.S. PATENT DOCUMENTS 4,188,812 * 2/1980 Nomura et al. ..... 72/227
4,437,947 * 3/1984 Saito et al. ..... 204/35

FOREIGN PATENT DOCUMENTS 3-38343 6/1991 (JP) .
4-36498 2/1992 (JP) .
6-74507 9/1994 (JP) .
06322592 11/1994 (JP) .

* cited by examiner

*Primary Examiner*—Kathryn Gorgos
*Assistant Examiner*—Christopher M. Keehan
(74) *Attorney, Agent, or Firm*—Pillsbury Winthrop LLP

(57) ABSTRACT

Method and appartus suitable for forming promptly a phosphate film of excellent performance for cold drawing on the steel wires are disclosed.

The steel wires are descaled by cathodic electrolysis in acid solution, and thereafter, phosphate film are formed by cathodic electrolysis on the steel wires.

Contacting with the solution containing colloidal titanium are preferable to be carried out between cathodic descaling process and phosphate film forming process. Descaling of cathodic electrolysis may preferably be performed in acid solution at a temperature of lower than 90° C. and in 1~100 A/dm$^2$. Phosphate film forming may preferably be performed by using electrolyte containing Zn ion, phosphoric acid ion and nitric acid ion, at a temperature of lower than 90° C., in 1~100 A/dm$^2$ and for 1~30 seconds.

3 Claims, 1 Drawing Sheet

METHOD FOR FORMING PHOSPHATE FILM ON THE STEEL WIRES AND APPARATUS USED THEREFORE

FIELD OF THE INVENTION

Hot rolled or heat treated steel rods and steel wires (hereafter abbreviated as steel wires) are often provided for a cold drawing process. Before cold drawing, usually a phosphate film is formed on a surface thereof. This Invention relates to a method and an apparatus for promptly forming phosphate film having an excellent performance.

BACKGROUND ART

In the cold drawing operation, the phosphate film is further covered by a lubricant such as metallic soap, and the phosphate film may carry the metallic soap forming a lubricative layer. In the cold drawing, a diameter of the steel wires become decreased by passing through several dies, and it is preferred that the phosphate film may keep its excellent performance until the steel wires passes through the last die.

The phosphate film is often formed by dipping the steel wires into a bath where a solution for making the phosphate film are contained and no electrolytic deviced are provided. In this case, a productivity of the processing bath is able to be enhanced by increasing the travelling speed of the steel wires if a prompt formation of the phosphate film become possible.

Accordingly, a method being possible to form the phosphate film promptly is preferable. In order to form the phosphate film promptly, a liquid containing chemicals of forming phosphate film in high concentration has been used. However, in this case, a great deal of sludge is produced in the liquid, and it must be frequently removed in order to obtain a phosphate film of excellent quality.

In the process of forming the phosphate film on the steel wires, the steel wires must be descaled previously by dipping it into the hydrochloric or sulfuric acid solution. And steel wires being removed its oxide film by this descalling process are dipped into the forming solution of phosphate film.

The present inventors had found a electrolytic process where phosphate film can be formed promptly by using the steel wires as electrolytic cathode in a solution of not containing a complexing agent, and filed it in JP4-36498A.

According to the electrolytic process of JP4-35498A, a productivity of the phosphate film formation had been much enhanced, however, it does not improved the quality of the phosphate film, and the quality of the phosphate film by this process had almost been in the same level as those produced by conventional process.

JP6-322592A disclosed a formation of phosphate film on the steel wires by electrolytic process. However, this is a process of using the steel wires as anode. Also, this is a process of using the pulse electrolytic current in the electrolytic operation.

DISCLOSURE OF THE INVENTION

As explained above, a productivity of the phosphate film formation had been much enhanced by the electrolytic process of JP4-36498A, however, it does not improve the quality of the phosphate film. The presen inventors further studies JP4-36498A process, and suceeded to improve the quality of the phosphate film.

According to a new findings of the inventors, the quality of the phosphate film has a close relation with the descaling process of steel wires. As explained before, in the process of forming the phosphate film on the steel wires, the steel wires are descaled previously by dipping it into the hydrochloric or sulfuric acid solution. In this descaling process, oxide film may be removed from the steel wires. However, it leaves smut on the surface of the steel wires.

The smut formed may usually be removed by rinsing the steel wires in a water. However, small amount of smut remained on the surface of the steel wires may form the phosphate film of insufficient quality. The smut may decrease a adhesive strength of the phosphate film to the surface of the steel wires, resulting an insufficient lubricative properties in cold drawing of the steel wires and an insufficient surface properties of the final product of the steel wires.

The purpose of the invention is, therefore, to provide a new method and an new apparatus, suitable for more promptly forming the phosphate film having more excellent quality than the conventional process on the steel wires of low carbon grades, a high-carbon grades and a low alloy containing grades without generating any smut and any sludge.

The present invention is (1): a method for forming phosphate film on steel wires comprising a descaling process and a phosphate film forming process characterized in that the descaling process is a an electrolytic pickling of steel wires using the steel wires as cathode and using as acid solution other than phosphoric acid as an electrolyte, and the phosphate film forming process is an electrolytic process using the steel wires as cathode and using a forming solution of phosphate film as an electrolyte.

Also, the present invention is (2): a method used for forming phosphate film on steel wires comprising a descaling process, an intermediate process and a phosphate film forming process characterized in that the descaling process is a electrolytic pickling of the steel wires using the steel wires as cathode and using acid other than a phosphoric acid as an electrolyte, and the intermediate process is a process of contacting the steel wires with a intermediate liquid containing colloidal titanium and alkali metal phosphate, and the phosphate film forming process is an electrolytic process using the steel wires as cathode and using forming solution of phosphate film as an electrolyte.

Also, the present invention is (3): a method used for forming phosphate film in steel wires according to (1) or (2) above, characterized in that the steel wires for the descaling process are the steel wires being mechanically descaled as a pretreatment therefor.

Also the present invention is (4): a method used for forming phosphate film on steel wires according to any of (1)~(3) above, characterized in that an electrolyte in the descaling process is selected from sulfuric acid, hydrochloric acid, nitric acid, hydrofluoric acid, hydrosilicofluoric acid and zircon hydrofluoric acid, and a temperature of the electrolyte is 90° C. or lower in the descaling process, and a current density of the steel wires is 1 $A/dm^2$~100 $A/dm^2$ in D.C. and an electrolytic time is 1~60 seconds in the descaling process.

Also, the present invention is (5): a method used for forming phosphate film on steel wires according to any of (1)~(4) above, characterized in that an electrolyte in the phosphate film forming process contains 2~60 g/liter of zinc ion, 2~80 g/liter of phosphoric acid ion and 3~100 g/liter of nitric acid ion, and a molar ratio of zinc ion to phosphoric acid ion is 0.9~1.5 and a molar ratio of nitric acid ion to phosphoric acid ion is 0.7~2.5, temperature of the electrolyte is 90° C. or lower, and the current density of the steel wires is 1 A/dm$^2$~100 A/dm$^2$ in D.C. and an electrolytic time is 1~13 seconds in the phosphate film forming process.

Also, the present invention is (6): an apparatus used for forming phosphate film on steel wires comprising a descaling bath and a phosphate film forming bath characterized in that the descaling bath is an electrolytic pickling bath of steel wires using steel wires as cathode and using acid other than phosphoric acid as an electrolyte, and the phosphate film forming bath is an electrolytic film forming bath using the steel wires as cathode and using a forming solution of phosphate film as an electrolyte.

Also, the present invention is (7): an apparatus used for forming phosphate film on steel wires comprising a descaling bath, an intermediate bath and a phosphate film forming bath characterized in that the descaling bath is an electrolytic pickling bath of steel wires using steel wires as cathode and using acid other than phosphoric acid as an electrolyte, and the intermediate bath is a bath of contacting the steel wires with a intermediate liquid containing colloidal titanium and alkali metal phosphate, and the phosphate film forming bath is an electrolytic film forming bath using steel wires as cathode and using a forming solution of phosphate film as an electrolyte.

Also, the present invention is (8): an apparatus used for forming phosphate film on steel wires according to (6) or (7) above characterized in that the apparatus further has a mechanical descaler prior to the descaling bath.

Also, the present invention is (9): an apparatus used for forming phosphate film on steel wires according to (8) above characterized in that the apparatus further has an auxiliary acid picking bath in between the mechanical descaler and the descaling bath, and the auxiliary acid pickling bath is either one of non electrolytic acid pickling bath or electrolytic acid pickling bath of using the steel wires as anode.

Figure 1:
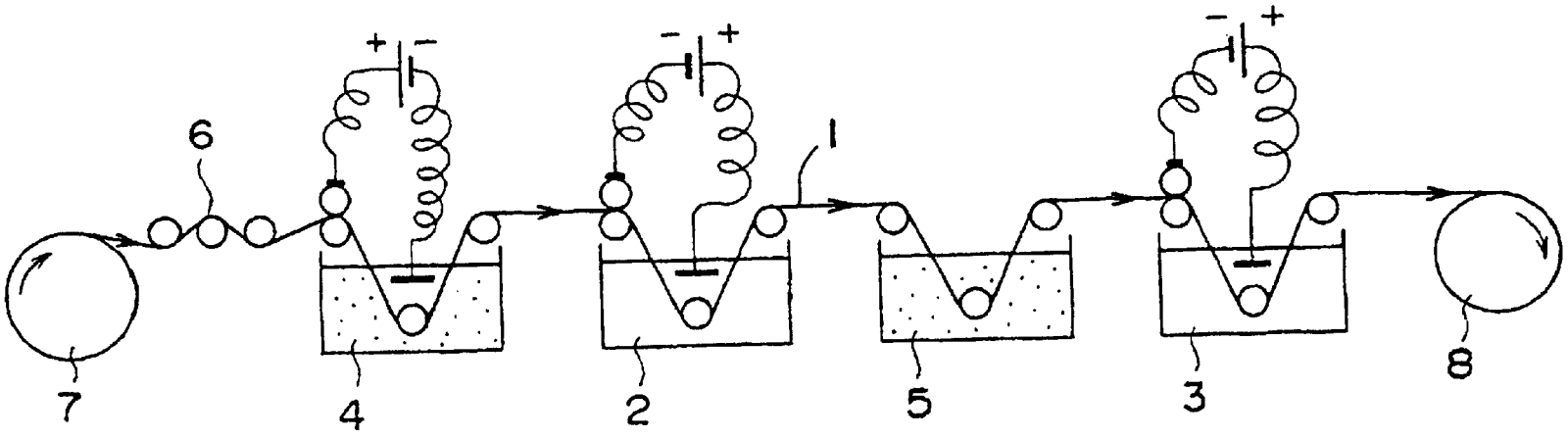
FIG. 1 illustrates an embodiment example of apparatus of the invention.

1: steel wires, 2: descaling bath, 3: phosphate film forming bath, 4: auxiliary acid pickling bath, 5: intermediate bath, 6: mechanical descaler, 7: uncoiler, 8: coiler.

BEST MODE FOR CARRYING OUT THE INVENTION

The inventors have investigated a surface of the steel wires after a pickling treatment. In the conventional acid pickling such as dipping the steel wires in hydrochloric acid or sulfuric acid, many large pitting hole can be observed on the surface of the steel wires, and also can be observed many dark colored smuts composed by deposit and redeposit of insoluble and soluble compounds such as carbon, ferric oxides or the like adhered on the surface of the steel wires. On the other hand, no such smut were entirely observed and the surfaces of the steel wires were very clean in the electrolytic pickling process of the present invention.

When the steel wires are used as cathode, a cathode reaction of generating a hydrogen gas may occur in a short time on the surface of the steel wires and a physical movement by the hydrogen gas may clean the surface of the steel wires. Also, hydrogen ion gathered in high concentration near the surface of the steel wires may clean the surface of steel wires. Thereby, the surface of the steel wire is less roughened and no smut is formed thereon.

In the invention, the electrolysis is carried out by using the steel wires as cathode. On the other hand, in the conventional process, there may be a case wherein the electrolysis is carried out using the steel wires as anode. In this anode electrolysis, the iron may dissolve into the electrolytic solution as iron ion and the iron ion may be a cause of the smut on the surface of the steel wires. In the usual descaling of the steel wires of dipping it into the acids, the iron may dissolve into the acid solution as the iron ion, and the iron ion may become the cause of the smut on the surface of the steel wires. In this invention, the electrolysis is carried out by making the steel wires as cathode, $H^+$ ions are attracted toward the steel wires and are discharged on the surface of the steel wires and thereby $H_2$ gas is generated from the steel wires. Thus, the cathode electrolysis of the invention is not an electrolysis dissolving the iron as iron ion and the smut is not generated on the surface of the steel wires.

Further, according to a new knowledge obtained by the inventors, in the conventional method wherein the anode pickling are carried out before the phosphate film forming process, much slugs can also be observed in the phosphate film forming bath.

Further, the performance of the phosphate film as the lubricative layer becomes decreased in this case.

In the present invention, the descaling is carried out by using the steel wires as cathode. And according to the new knowledge obtained by the inventors, the steel wires wherein this cathode electrolytic pickling is carried out, never generate any sludge in the subsequent process of forming the phosphate film. Also, when this cathode electrolytic pickling is carried out, smut is not generated on the surface of the steel wires and the adhesive strength of the phosphate film to the surface of the steel wires becomes much enhanced and the performance of producing the lubricative layer is remarkably improved.

The sulfuric acid solution is preferably used for the electrolytic pickling in the invention and either one or more than one selected from sulfuric acid, hydrochloric acid, nitric acid, hydrofluoric acid, hydrosilicofluoric acid and zircon hydrofluoric acid may be used. The acid concentration is preferred to be 5~40%.

In the electrolytic pickling of the invention, preferable current density is 1~100 A/dm$^2$ and more preferably be in 20~50 A/dm$^2$. When the current density less than is 1 A/dm$^2$, the occurring amount of hydrogen gas is little and an sufficient washing strength is not obtainable. Also, if more than 100 A/dm$^2$, it is economically not preferable because early degradation of the processing liquid may be resulted. The liquid temperature is 90° C. or less, and preferably 50~80° C. The processing time is 1~60 seconds, and preferably 1~30 seconds.

In the hot rolled steel wires and the heat treated steel wires, the surface of steel wires are often covered by thick scale. In order to remove this thick scale on the surface of the steel wires, usually the mechanical descaling such as bending descaling, shot blast descaling, air blast descaling or the like is carried out thereon. The descaling by cathode electrolytic pickling is carried out after this mechanical descaling. When this mechanical desscaling is insufficient, another conventional acid pickling of using non electrolytic pickling bath or using electrolytic acid pickling bath of making the steel wires as anode may additionally be applied after the mechanical descaling.

However, in this case, the cathode electrolytic pickling of the invention has to be carried out after the conventional acid pickling of above.

In the invention, the phosphate film forming process is carried out after the descaling process of cathode electrolytic pickling. It is known that a structure of the phosphate film becomes fine and improved when the steel wires are contacted with a liquid wherein colloidal titanium and alkali metal phosphate are contained. When this process is applied in the invention, an intermediate bath wherein a liquid having colloidal titanium and alkali metal phosphate is contained may be provided between the descaling bath and the phosphate film forming bath, and the steel wires is made to contact with the intermediate liquid after the cathode electrolytic pickling. As explained before, sufficiently clean surface of steel wires is difficult to obtain by conventional descaling process, however, in the present invention, cathode electrolytic pickling is carried out after conventional descaling process, and sufficiently clean surface of steel wires is obtained by this cathode electrolytic pickling.

In the invention, after the cathode electrolytic pickling, phosphate film forming process is carried out by using the direct current electrolysis, making the steel wires as cathode and using a phosphate film forming liquid as electrolyte.

The phosphoric acid in the phosphate film forming liquid may dissociate like the following.

$$H_3PO_4 \Leftrightarrow H^+ + H_2PO_4^- \Leftrightarrow 2H^+ + HPO_4^{2-} \Leftrightarrow 3H^+ + PO_4^{3-}.$$

In the above equation, $PO_4^{3-}$ ion may combine metallic ion and may produce a metal phosphate compound. And this metal phosphate compound is deposited on the surface of steel wires, and may become a suitable phosphate film. When $H^+$ ion in the phosphate film forming liquid is in high concentration near the steel wires, above equation may proceed to the left direction, $PO_4^{3-}$ content near the steel wires may decreased, and the phosphate compound is not formed. On the other hand, when $H^+$ ion concentration in the phosphate film forming liquid may become low, above equation may proceed to the right direction, $PO_4^{3-}$ content near the steel wires may increase, and the metal phosphate compound are formed and deposited on the surface of steel wires.

In the convention dipping process, the steel wires is corroded by the phosphate film forming liquid as chemical reaction of $Fe+2H^+ \rightarrow Fe^{2+}+H_2$. In this chemical reaction, $H^+$ ion near the steel wires may be consumed and its concentration may decrease, and $PO_4^{3-}$ ion concentration near the steel wires may increase, and the metal phosphate compound is produced on the surface of the steel wires. However, in the conventional process of above, Fe has to be changed into $Fe^{2+}$, and $Fe^{2+}$ ion has to be dissolved into the phosphate film forming liquid, and the dissolved $Fe^{2+}$ may cause the trouble of producing the smut and sludge. On the other hand, in the present invention, the direct current electrolysis is carried out by using the steel wires as cathode. In this cathode electrolysis, $H^+$ ion is attracted to the cathode and are consumed as discharge reaction of $2H^+ \rightarrow H_2$. As the result of this discharge reaction, $H^+$ ion concentration near the steel wires becomes low, and $PO_4^{3-}$ ion concentration becomes high, and the metal phosphate compound are deposited on the surface of of the steel wires. Namely, according to the present invention, $H^+$ ion concentration near the steel wires is decreased by the electrolytical discharge. Accordingly, the iron does not dissolve into the phosphate film forming liquid, and the smut and the sludge being produced by dissolved iron ion does not arise in the present invention.

In the conventional dipping process of forming the phosphate film, Fe is dissolved and the $H^+$ ions concentration is lowered, and phosphate film is formed with the velocity according to the lowering speed of the $H^+$ ion concentration. However, it is hard to dissolve Fe with the high speed and accordingly it is difficult to form the phosphate film with high speed. On the one hand, in the present invention, the $H^+$ ion concentration is decreased by the discharge of the $H^+$ ion, and the velocity of discharge of $H^+$ ion may be controlled by adjusting a current dencity of the electrolytic process. And, in the present invention, it is possible to form the phosphate film with high speed by controlling the current dencity of the electrolytic process.

Even if a method of forming the phosphate film is the cathode electrolysis as in the invention, the performance for the phosphate film is insufficient when the pickling is not by the process of cathode electrolysis. When the descaling is made by the cathode electrolysis of the invention and the phosphate film making is by the cathode electrolysis of the invention, the phosphate film having a sufficient performance is formed with high speed.

As to an electric terminal of connecting the steel wires to the electricity supply source, bipolar type electric terminal can be used in the present invention. In the bipolar type electric terminal, electrode of the electricity supply source are immersed in the electrolyte, and electric current is supplied to the steel wires via the electrolyte. In case of using bipolar type electric terminal, electrode of the electricity supply source does not contacted with the steel wires directly, and the phosphate film may be produced smoothly with out arising the defects on the surface of the steel wires and the phosphate film.

The forming solution of phosphate film in the invention may preferably contain zinc ion 2~60 g/liter, phosphoric acid ion 2~80 g/liter and nitric acid ion 3~100 g/liter, and is the liquid wherein molar ration of the zinc ion to the phosphoric acid on is 0.9~1.5 and molar ration of nitric acid ion to the phosphoric acid ion is 0.7~2.5. When concentration of zinc ion, phosphoric acid ion and the nitric acid ion is less than the above, the phosphate film becomes not easy to be formed. Also, exceeding the above, it is not preferable economically and the adhesive property of the phosphate film is the steel wires is decrease thereby.

When molar ratio of (zinc ion/phosphoric acid ion) is less than 0.9, a zinc eutectoid occurs, a good film is hard to be obtained and an adhesive property of the phosphate film becomes worse. However, exceeding 1.5, it is not preferred economically.

Also, when molar ratio of (nitric acid ion/phosphoric acid ion) is less than 0.7, a stability of the liquid is decreased and exceeding 2.5, a required film weight is hard to be obtained due to a self oxidation.

Further, nickel phosphate, manganese phosphate, calcium phosphate are able to be made to contain into this forming solution of phosphate film. Further nitrous acid ion, hydrogen peroxide and chloric acid ion are able to be added as an oxidant.

When the oxidant is nitrous acid ion, the content thereof is preferred to be 0.05~0.18 g/liter. The inventors picked up the electrolyte by 10 mil liters and using phenolphthalein as an indicator, titrate this with 0.1 N—NaOH solution and calling the mil liter of 0.1 N—NaOH solution as point, and the electrolyte is preferred to be in 5~200 point.

The electrolysis of the phosphate film formation is preferably carried out by making the temperature of electrolyte at 90° C. or less, more preferably at 50~80° C., and the current density may preferably be 1~100 A/dm$^2$, more preferably 20~50 A/dm$^2$. When the current density if less than 1 A/dm$^2$, the phosphate film is not easy to be formed and when exceeding 100 A/dm$^2$ adhesive properties of the film may be decreased.

It is known in the conventional process that the steel wires may be contacted with a liquid containing a colloidal titanium and alkali metal phosphate salt, and thereafter the phosphate film is formed. In this process the titanium compound absorbed on the steel wires becomes a core of the crystal of the deposited phosphate and thereby a phosphate film having a fine structure may be obtained.

In the present invention, the contact of the steel wires with the liquid containing colloidal titanium and alkali metal phosphate salt may be carried out after the descaling process and before the phosphate film forming process. And the phosphate film are further improved by this treatment. Namely, a extremely preferable lubricative phosphate film having an excellent adhesive properties and an excellent fineness is obtained. In this treatment, the same liquids with those used in the conventional process may be used. Those liquids may contain colloidal titanium, pyrophosphoric acid ion, orthophosphoric acid ion and sodium ion as described in, for example, JP3-38343B2 and JP6-74507B2. The steel wires may be dipped in those treating liquid of room temperature, for about 1~5 seconds.

In the cathode electrolysis of the phosphate film formation of the invention, pH of the electrolyte is preferred to set near the pH range suitable for depositing $Zn_3(PO_4)_2$. In order to keep the pH of the electrolyte near this pH range, the equilibrium constant k mentioned below is able to make as a standard.

$$K=\{[Zn_3(PO_4)_2\}\times[H_3PO_4]^4/\{Zn(H_2PO_4)_2\}^3$$

Also, more simply, the acid ratio shown in below can be used.

{total acidity (point)}/{free acidity (point)}

Relation between temperature and acid ratio is preferred to keep the acid ratio as 4.5~6 at higher than 80° C., and as 6~9 at 60~80° C. When a treating temperature is low, the higher the acid ratio may be preferable in order to form the phosphate film easily. In the phosphate film forming process by the cathode electrolysis, the phosphate film can be formed more efficiently by controlling a quality of the effective components. As a standard of this control of the amount of the effective components, it is preferable to keep the value of the following equation to be 2.5~6.0.

{total activity (TA)−free acidity (FA)}/{free acidity (FA)}.

By this control, a high quality phosphate film is able to be obtained promptly. In case the steel wires is a hard steel wire, $$\{(TA)-(FA)\}/\{(FA)\}=3.5\sim5.5$$

is the most preferable.

FIG. 1 is a example of the apparatus of the invention. The apparatus of the invention has a descaling bath 2 for electrolytic descaling the steel wires using the steel wires 1 as cathode, and at the rear side of the descaling bath 2, a phosphate film forming bath 3 for forming the phosphate film on the steel wires by electrolysis using the steel views 1 as cathode is provided. In the descaling bath 2, the electrolyte selected from acids other than the phosphoric acid, for example, such as sulfuric acid, hydrochloric acid, nitric acid, hydrofluoric acid, hydrosilicofluoric acid, zircon hydrofluoric acid or the like is contained and the steel wires 1 are cleaned by the cathode electrolytic pickling, for example, by using D.C. current and in current density of 1 $A/dm^2$~100 $A/dm^2$. In the phosphate film forming bath 3, the phosphate film forming liquid, for example, having zinc ion, phosphoric acid ion and nitric acid ion is contained and the phosphate film is formed on the steel wires in the current density, for example, 1 $A/dm^2$~100 $A/dm^2$.

FIG. 1 shows a contact roll for a electric terminal of contacting the steel wires to the electricity supply source, however, other non-contact electric terminal for example a bipolar type electric terminal can be used. As an anode in FIG. 1, such insoluble anode as those wherein Pt is coated on the titanium or graphite electrode can be used.

In the invention, intermediate bath 5 may also be provided after the descaling bath 2 and before phosphate film forming bath 3. In this intermediate bath 5, the surface adjusting liquid including colloidal titanium and alkali metal salt is contained. When the steel wires 1 are made to contact with this surface adjusting liquid, a fine phosphate film of excellent quality is formed in the phosphate film forming bath 3.

6 in FIG. 1 is an example of the mechanical descaler of 3 rolls types. As a mechanical descaler, a different type of mechanical descaler such as a shot blast or the like may be used. 4 in FIG. 1 is an example of a auxiliary acid pickling bath and is arranged before the descaling bath 2. The auxiliary pickling bath may be an acid pickling bath of using the steel wires 1 as anode or non-electrolytic acid pickling bath used in order to mitigate the workload of the descaling bath 2.

Although not shown in FIG. 1, a publicly known water rinsing apparatus or a hot water rinsing apparatus are provided btween each bath in order to prevent that a liquid of preceding bath is brought into the following bath. Also, a publicly known stirring apparatus of liquid is able to be arranged in order to enhance a reactivity of the steel wires 1 with a liquid in each bath. Also, a counter flow of flowing the liquid toward a opposite direction against the running direction of the steel wires 1 may be applied in order to promote the reaction in the bath. 7 in FIG. 1 is an example of uncoiler and 8 is an example of coiler.

EMBODIMENT EXAMPLE AND COMPARATIVE EXAMPLE

JIS-SWRH72A steel wires (C content is 0.72 wt %) having a diameter of 5.5 mm is cold drawn by a continuous drawing method.

Before cold drawing operation, phosphate films are formed on the surface of the steel wires with a different method. Table 1 shows an outline thereof. All steel wires were mechanically descaled previously and the scale of 90% or more were removed. An usual metallic soap powder obtained in the market is used as a lubricant in cold drawing.

In descaling column of Table 1, process C shows an electrolytic pickling using the steel wires as cathode, and process A shows an electrolytic pickling using the steel wires as anode. In this column, process of A→C shows an example wherein the anodic electrolysis is carried out in the first half of the pikling time, and the latter half of the pickling time is carried out in cathode electrolysis. Also process of C→A shows that the early half is cathodic and late half is anodic. In this column, process of dip shows a non-electrolytic process. All the electrolyte as well as the dipping solution are sulfuric acid having 25% concentration.

In the intermediate column of Table 1, ○ shows the contacting with the intermediate solution comprising colloidal titanium and alkali metal phosphate produced by using PREPAREN 2 (products by Nihon Parkerizing Co. LTD.).

In phosphate film forming column of Table 1, process C shows the electrolysis by using the steel wires as cathode, and process dip shows non-electrolysis. An electrolyte as well as dipping solution are produced by using PARBOND-TD-805 (a phosphate film forming agent produced by Nihon Parkerizing Co,LT D.) and the total acid of the liquid is adjusted to be 90 point.

In phosphate film forming column of Table 1, before ($g/m^2$) shows an amount of phosphate film measured before cold drawing, and after ($g/m^2$) shows an amount of phosphate film measured after cold drawing. The amount of phosphate film can be determined by dipping the steel wires into the aqueous solution containing chromic acid by 5%, thereby all phosphate film are removed from the steel wires. And the amount of phosphate film may be determined by measuring the weight of steel wires before and after the chromic acid treatment.

In comparative examples, current dencity ($A/dm^2$) of descaling is too low in No.1, current dencity ($A/dm^2$) of phosphate film forming is too high in No.2, descaling were non-electrolytic in No.3~4, phosphate film forming were non-electrolytic in No.3 and 5 and the treating time (sec) in phosphate film forming is too short in No.6. And in these comparative examples, sludge decreasing effect and the drawability were insufficient.

In embodiment examples of No.13~14, the first half of the descaling were anodic electrolysis, however the latter half were cathodic electrolysis. In these cases, sludge decreasing effect and the drawability were excellent. On the other hand, in comparative examples of No.7~8, the first half of the descaling were cathodic electrolysis and the latter half were anodic electrolysis. In these cases, sludge decreasing effect and the drawability were insufficient.

TABLE 1

| | | Descaling | | | | Intermediate | Phosphate Film Forming | | | | | | | | |
|---|---|---|---|---|---|---|---|---|---|---|---|---|---|---|---|
| | | Process | $A/dm^2$ | ° C. | sec. | | Process | $A/dm^2$ | ° C. | sec. | Before ($g/m^2$) | After ($g/m^2$) | Crystal Size ($\mu m$) | Sludge | Drawability |
| embodiment example | 1 | C | 1 | 90 | 20 | ○ | C | 100 | 70 | 1 | 8.1 | 1.6 | 2~5 | ○ | ○ |
| | 2 | C | 10 | 90 | 10 | ○ | C | 100 | 70 | 1 | 8.4 | 1.7 | 2~5 | ○ | ○ |
| | 3 | C | 20 | 80 | 5 | ○ | C | 70 | 80 | 2 | 9.8 | 1.8 | 2~5 | ○ | ◎ |
| | 4 | C | 30 | 80 | 5 | ○ | C | 50 | 80 | 5 | 11.4 | 2.0 | 2~5 | ○ | ◎ |
| | 5 | C | 30 | 80 | 5 | ○ | C | 25 | 80 | 5 | 9.8 | 1.9 | 2~5 | ○ | ◎ |
| | 6 | C | 50 | 80 | 5 | ○ | C | 30 | 80 | 5 | 10.0 | 1.9 | 2~5 | ○ | ◎ |
| | 7 | C | 70 | 70 | 2 | ○ | C | 20 | 80 | 10 | 11.1 | 1.9 | 2~5 | ○ | ○ |
| | 8 | C | 90 | 70 | 1 | ○ | C | 10 | 90 | 10 | 10.2 | 1.8 | 2~5 | ○ | ○ |
| | 9 | C | 100 | 50 | 1 | ○ | C | 1 | 90 | 20 | 8.0 | 1.7 | 2~5 | ○ | ○ |
| | 10 | C | 5 | 80 | 10 | — | C | 10 | 80 | 5 | 8.5 | 1.1 | 20~30 | ○ | ○ |
| | 11 | C | 25 | 70 | 20 | — | C | 50 | 50 | 15 | 9.2 | 1.3 | 20~30 | ○ | ○ |
| | 12 | C | 50 | 50 | 5 | — | C | 100 | 70 | 10 | 10.9 | 1.3 | 20~30 | ○ | ○ |
| | 13 | A→C | 30 | 80 | 5 | ○ | C | 25 | 80 | 5 | 11.8 | 1.1 | 2~5 | ○ | ◎ |
| | 14 | A→C | 30 | 80 | 5 | — | C | 25 | 80 | 5 | 10.1 | 1.0 | 20~30 | ○ | ○ |
| comparative example | 1 | C | 0.5 | 90 | 1 | ○ | C | 0.5 | 90 | 20 | 5.4 | 0.1 | 5~10 | Δ | X |
| | 2 | C | 20 | 90 | 5 | ○ | C | 150 | 80 | 10 | 15.0 | 0 | 2~5 | Δ | X |
| | 3 | Dip | 0 | 70 | 5 | ○ | Dip | 0 | 70 | 5 | 6.2 | 0.4 | 10~20 | X | Δ |
| | 4 | Dip | 0 | 80 | 10 | ○ | C | 10 | 70 | 10 | 9.6 | 0.7 | 10~20 | Δ | Δ |
| | 5 | C | 25 | 60 | 10 | — | Dip | 0 | 80 | 2 | 3.5 | 0 | 20~30 | X | X |
| | 6 | C | 25 | 80 | 10 | ○ | C | 20 | 80 | 0.5 | 1.5 | 0 | 5~10 | ○ | X |
| | 7 | C→A | 30 | 80 | 5 | ○ | C | 25 | 80 | 5 | 9.6 | 1.1 | 5~10 | Δ | Δ |
| | 8 | C→A | 30 | 80 | 5 | — | C | 25 | 80 | 5 | 9.3 | 0.9 | 20~30 | Δ | X |

In the same column of Table 1, crystal size shows a crystal sizes ($\mu m$) of the phosphate film measured by using a scanning electron microscope.

Sludge column in Table 1 shows an amount of sludge in the phosphate film forming solution measured after being used in operation for one hour. Wherein ○ shows transparent and no sludge, Δ shows little sludge of less than 3 g/L, and X shows much sludge of more than 3 g/L.

Drawability column in Table 1 shows that ◎ is a case wherein more than 50 ton of steel wires was cold drawn through the final die, ○ is a case wherein 15~50 ton of steel wires was able to be cold drawn through the final die, Δ is a case wherein less than 15 ton of steel wires was able to be cold drawn through the final die, and X shows a case wherein defective product was produced in cold drawing.

Embodiment example No.1~12 in Table 1 are showing that the descaling and the phosphate film forming has been performed by electrolytic process and electrolytic process were carried out within the scope of the present invention. In these examples sludge were not observed in the phosphate film forming solution and their drawability were very excellent. Embodiment No.1~9 in Table 1 were treated in the intermediate solution and their crystal size of the phosphate film were finer than those of Embodiment No.10~12 wherein treatment in the intermediate solution were not carried out.

In comparative example No.3, phosphate film forming was carried out by dipping for 5 seconds, and the amount of produced phosphate film was 6.2 ($g/^2$). However, 6.2 ($g/m^2$) is less than the amount of phosphate film obtained in embodiment examples of No.1~14 wherein phosphate film forming were carried out by cathodic electrolysis. In the same way, as shown in comparative example No.5, the amount of phosphate film of 3.5 $g/m^2$ obtained by dipping process is less than those in embodiment examples of No.1~14.

Table 1 is the examples performed on the steel wires of high carbon grade. Although not shown in the specification, the inventors had further carried out the similler test on the steel wires of low carbon grades and low alloy containing grades, and the similler results with those in Table 1 were obtained.

ADVANTAGES OF THE INVENTION

According to the invention, the phosphate film of more excellent performance for cold drawing is able to be formed more promptly on the steel wires of low carbon grade, high carbon grade and low alloy containing grade than in the conventional process.

Further, the operation for removing sludges from the liquid bathes is able to be much decreased since sludges are not produced in the process of the invention.

What is claimed is:

1. A method for forming phosphate film on steel wires comprising a descaling process and a phosphate film forming process, wherein no smut or sludge is generated during the descaling process or the phosphate film forming process, wherein the descaling process is an electrolytic pickling of steel wires using the steel wires as cathode and using acid other than phosphoric acid as an electrolyte, and the phosphate film forming process is an electrolytic process using the steel wires as cathode and using a forming solution of phosphate film as an electrolyte, wherein an electrolyte in the descaling process is selected from sulfuric acid, hydrochloric acid, nitric acid, hydrofluoric acid, hydrosilicofluoric acid and zircon hydrofluoric acid, and a temperature of the electrolyte is 90° C. or lower and a current density of the steel wires is 1 $A/dm^2$ to 100 $A/dm^2$ in D.C. and an electrolytic time is 1 to 60 seconds, and wherein an electrolyte in the phosphate film forming process contains 2 to 60 g/liter of zinc ion, 2 to 80 g/liter of phosphoric acid ion and 3 to 100 g/liter of nitric acid ion, and a molar ratio of zinc ion to phosphoric acid ion is 0.9 to 1.5 and a molar ratio of nitric acid ion to phosphoric acid ion is 0.7 to 2.5, temperature of the electrolyte is 90° C. or lower, the current density of the steel wires is 1 $A/dm^2$ to 100 $A/dm^2$ in D.C. and an electrolytic time is 1 to 30 seconds.

2. A method for forming phosphate film on steel wires comprising a descaling process, an intermediate process and a phosphate film forming process, wherein no smut or sludge is generated during the descaling process or the phosphate film forming process, wherein the descaling process is an electrolytic pickling of steel wires using the steel wires as cathode and using acid other than phosphoric acid as an electrolyte, and the intermediate process is a process of contacting the steel wires with an intermediate liquid containing colloidal titanium and alkali metal phosphate, and the phosphate film forming process is an electrolytic process using the steel wires as cathode and using a forming solution of phosphate film as an electrolyte, wherein an electrolyte in the descaling process is selected from sulfuric acid, hydrochloric acid, nitric acid, hydrofluoric acid, hydrosilicofluoric acid and zircon hydrofluoric acid, and a temperature of the electrolyte is 90° C. or lower and a current density of the steel wires is 1 $A/dm^2$ to 100 $A/dm^2$ in D.C. and an electrolytic time is 1 to 60 seconds, and wherein an electrolyte in the phosphate film forming process contains 2 to 60 g/liter of zinc ion, 2 to 80 g/liter of phosphoric acid ion and 3 to 100 g/liter of nitric acid ion, and a molar ratio of zinc ion to phosphoric acid ion is 0.9 to 1.5 and a molar ratio of nitric acid ion to phosphoric acid ion is 0.7 to 2.5, temperature of the electrolyte is 90° C. to lower, the current density of the steel wires is 1 $A/dm^2$ to 100 $A/dm^2$ in D.C. and an electrolytic time is 1 to 30 seconds.

3. A method for forming phosphate film on steel wires according to claim 1 or 2, wherein the steel wires for the descaling process are mechanically descaled as a pretreatment therefor.

* * * * *